United States Patent [19]

Kelly

[11] Patent Number: 4,567,740

[45] Date of Patent: Feb. 4, 1986

[54] LOCKING DEVICES

[76] Inventor: Eamonn W. J. Kelly, 23 Grange Park Crescent, Raheny, Dublin 5, Ireland

[21] Appl. No.: 536,439

[22] Filed: Sep. 27, 1983

[30] Foreign Application Priority Data

| | | | |
|---|---|---|---|
| Sep. 27, 1982 | [IE] | Ireland | 2328/82 |
| Dec. 1, 1982 | [IE] | Ireland | 2845/81 |
| Feb. 22, 1983 | [IE] | Ireland | 364/83 |
| Mar. 1, 1983 | [IE] | Ireland | 425/83 |
| Mar. 9, 1983 | [IE] | Ireland | 515/83 |
| Apr. 14, 1983 | [IE] | Ireland | 844/83 |
| Jun. 3, 1983 | [IE] | Ireland | 1312/83 |

[51] Int. Cl.[4] ..... E05B 67/38

[52] U.S. Cl. ..... 70/55

[58] Field of Search ..... 70/32–35, 70/38 R, 52, 54–56

[56] References Cited

U.S. PATENT DOCUMENTS

| | | | |
|---|---|---|---|
| 438,824 | 10/1890 | Price | 70/33 |
| 1,291,993 | 1/1919 | Matthews | 70/55 |
| 1,835,709 | 12/1931 | Jacobi | 70/52 X |
| 2,104,981 | 1/1938 | Falk | 70/33 |
| 3,606,423 | 9/1971 | McCarthy . | |
| 3,805,565 | 4/1974 | McLarnon | 70/33 X |
| 4,438,641 | 3/1984 | Levkov | 70/34 X |

FOREIGN PATENT DOCUMENTS

| | | | |
|---|---|---|---|
| 1365684 | 9/1974 | United Kingdom | 70/54 |
| 2111586A | 7/1983 | United Kingdom . | |

*Primary Examiner*—Robert L. Wolfe

*Attorney, Agent, or Firm*—Oblon, Fisher, Spivak, McClelland & Maier

[57] ABSTRACT

Locking devices for a variety of security purposes utilize a commercially available padlock of rectangular configuration having a sliding bolt (73) which bridges a recess in one side face of the padlock. A housing for this type of padlock is formed on or secured to a hasp (61) or other component which is to be locked to a staple (62). The housing has two wall portions (3, 64) and a foot portion (4) corresponding to the two main flat faces and the recessed side face of the padlock, and the padlock is a sliding fit in the housing. There is a slot (72) for entry of the staple (62) into the recess in the padlock. A guard plate (6) partly closes one end of the housing, in line with the bolt (73).

Locking devices are described for locking shutters and doors, particularly on commercial vehicles, and for locking security posts for blocking driveways or roadways.

In a twisting-rod housing mechanism for commercial vehicle doors, the padlock housing (1) is secured vertically to a twistable rod and the staple (226) is mounted so that it is horizontally slidable into and out of the slot in the housing.

11 Claims, 29 Drawing Figures

LOCKING DEVICES

BACKGROUND OF THE INVENTION

This invention concerns locking devices having a wide range of uses for security purposes, particularly for doors and shutters on commercial vehicles, for roller shutters, security doors and gates, or for posts used as security barriers, for blocking driveways, gateways or roadways, and for other similar purposes.

DESCRIPTION OF THE PRIOR ART

Padlocks are widely used for such purposes. However padlocks in exposed locations are vulnerable to tampering by unscrupulous persons.

One commercially available form of padlock has the general configuration of rectangular paralleliped with two main flat parallel faces, two end faces and two side faces, all of which are rectangular. At one side the body of the padlock has a deep slot so that two arms are formed, with the slot forming a recess between them. A bolt slides in bearings in the two arms; the bolt bridges the recess when the padlock is closed, and protrudes from one end face of the body when the padlock is open. The lock is operated by a key, inserted in a keyhole in the other end face. Padlocks of this kind, having a body made of brass, are commercially available, for example under the Trade Mark ALA from ALA s.n.c. di Antonio Letticino & Figli, 80040 Pollena, Naples, Italy.

It is also known to supply this kind of padlock with a protective casing of tempered steel which covers the two main faces and the two side faces of the padlock. The casing has substantially the same internal dimensions as the external dimensions of the padlock and so it grips the padlock very tightly; the padlock cannot move inside the casing and no additional means such as a rivet or screw is required to secure it therein. Both of the end faces of the padlock are left uncovered. Although the body of the padlock is protected on four faces, the padlock is used in the conventional manner in exposed locations where it is open to tampering.

SUMMARY OF THE INVENTION

It is an object of the invention to provide locking devices in which a padlock is used in a novel manner.

It is a further object of the invention to provide locking devices which combine the security advantages of a built-in lock with the convenience of a padlock for repair, replacement and for choice as to whether the lock should be retained in the locking structure or whether it should be removable therefrom when required.

The present invention provides a locking device comprising a staple and another component to be locked to the staple, wherein a metal padlock housing is formed on or secured to said other component, the housing being dimensioned to receive and shield a sliding-bolt padlock of rectangular configuration having two main flat faces and a side face which has a recess across which the bolt slides, said housing having two wall portions and a foot portion corresponding respectively to said two main faces and said side face of the padlock, and having a slot for entry of the staple into the recess in the padlock to engage the bolt.

The component to be locked to the staple may suitably be a hasp, which can be in the form of a plate or in another form appropriate to the use required. In another embodiment, the component to be locked to the staple is a rod in a twisting-rod locking mechanism such as is used on doors of delivery vehicles. In a further embodiment the component to be locked to the staple is a locking rod which prevents relative movement between two elements of an article, such as a foldable security post.

Among the advantages of locking devices as defined above are the folowing:

(a) the padlock has a fixed location on the locking device, in which it can be protected from tampering, (b) the housing, or the portions which form it, can be secured in position (e.g. by welding) before the padlock is inserted into the housing. Therefore there is no danger of the padlock being damaged by the welding or other attachment procedure. If an attempt were made to weld a tempered steel casing containing a padlock of the known kind mentioned above, there would be a considerable danger of damage to both the casing and the padlock. Furthermore the locking device of the invention can be electroplated before the padlock is inserted.

(c) Although the padlock can be secured in the housing by a rivet or screw, it is not held tightly by the walls of the housing and it can be removed if necessary after extraction of the rivet or screw, so that it can be repaired or replaced.

Preferably, the padlock housing and the component on which it is provided are made of untempered steel, particularly mild steel, which may be subsequently electroplated, or stainless steel.

According to a preferred feature of the present invention, a guard plate is provided at one end of the housing to bridge said wall portions. The guard plate protects one end face of the padlock in line with the bolt, to prevent unscrupulous persons from driving the bolt through said end face by hammering on the exposed end of the bolt at the other end face of the padlock. It also prevents the padlock from moving out of the housing at the end provided with the guard plate.

In one embodiment, the component to be locked to the staple is a twistable rod in a twisting-rod locking mechanism, particularly as used conventionally for doors on commercial vehicles. Preferably the padlock housing is secured to a vertical rod with the two wall portions of the housing arranged vertically (i.e. parallel to the axis of the rod), the slot being on the side of the housing remote from the rod and a guard plate as described above being at the lower end of the housing.

In another feature of the invention, the staple has a slide-mounting which permits the staple to slide into and out of the slot in the housing.

Alternatively a hasp with a padlock housing thereon may be secured to the twistable rod and may be used for both locking and twisting the rod adjacent to said foot portion.

According to another preferred feature of the invention, the housing has a bridge portion between the wall portions at the edges thereof remote from the foot portion. In this case, the housing shields the padlock on four sides. The bridge portion also gives greater rigidity to the housing, so that it (or a U-shaped portion of it) can be made of lighter metal.

In one aspect, this invention relates to locking devices for security posts which can be secured in the ground or another base but which can be removed or folded down without difficulty by authorised persons. Such posts are useful as security barriers, for blocking driveways, gateways or roadways and for other similar purposes.

A known form of security post assembly comprises a base tube which is sunk into the ground and a post which fits inside the mouth of the tube so as to be supported in a vertical position. The post has a staple projecting from one side thereof. This staple engages through an aperture in a plate which is hinged to the top of the base tube, and the shackle of a padlock can then be fitted through the staple to secure the two components together. When the post has been removed from the base tube, the hinged plate acts as a cover for the mouth of the base tube.

However the locking device on this type of assembly is vulnerable to damage or tampering because of the exposed position of the staple and padlock.

In one aspect, therefore, the present invention provides a locking mechanism for a security post assembly comprising a base tube and a post adapted to fit into the mouth thereof, wherein the locking mechanism comprises an arm hinged to the base tube adjacent to the mouth thereof, a plate fixed to the arm and adapted to be swivelled with the arm between a covering position in which it covers the mouth of the base tube and an upright position in which it stands beside the post but defining a space between the plate and the post, an aperture extending parallel to the plate through the arm in part of the arm which lies in said space when the plate is in the upright position and which forms a staple, and a padlock housing (as described above) on the post to co-operate with the arm so that the arm can be secured to the post by a padlock received in said housing.

In another aspect, the present invention provides a locking mechanism for a security post assembly comprising a base tube and a post hinged thereto or adapted to fit into the mouth thereof in overlapping relationship, wherein the locking mechanism comprises a staple secured to the tube or the post and a rigid rod or bar having a padlock housing as described above fixed thereto, the tube and post being provided with aligned apertures or a bearing through which the rigid rod or bar can be inserted, in such a position that insertion of the rigid rod or bar brings the staple into the recess in the padlock.

Other features and advantages of the various embodiments will be apparent from the description which follows.

BRIEF DESCRIPTION OF THE DRAWINGS

Various embodiments of the invention are illustrated in the accompanying drawings, in which.

DESCRIPTION OF THE PREFERRED EMBODIMENTS

Figure 1:
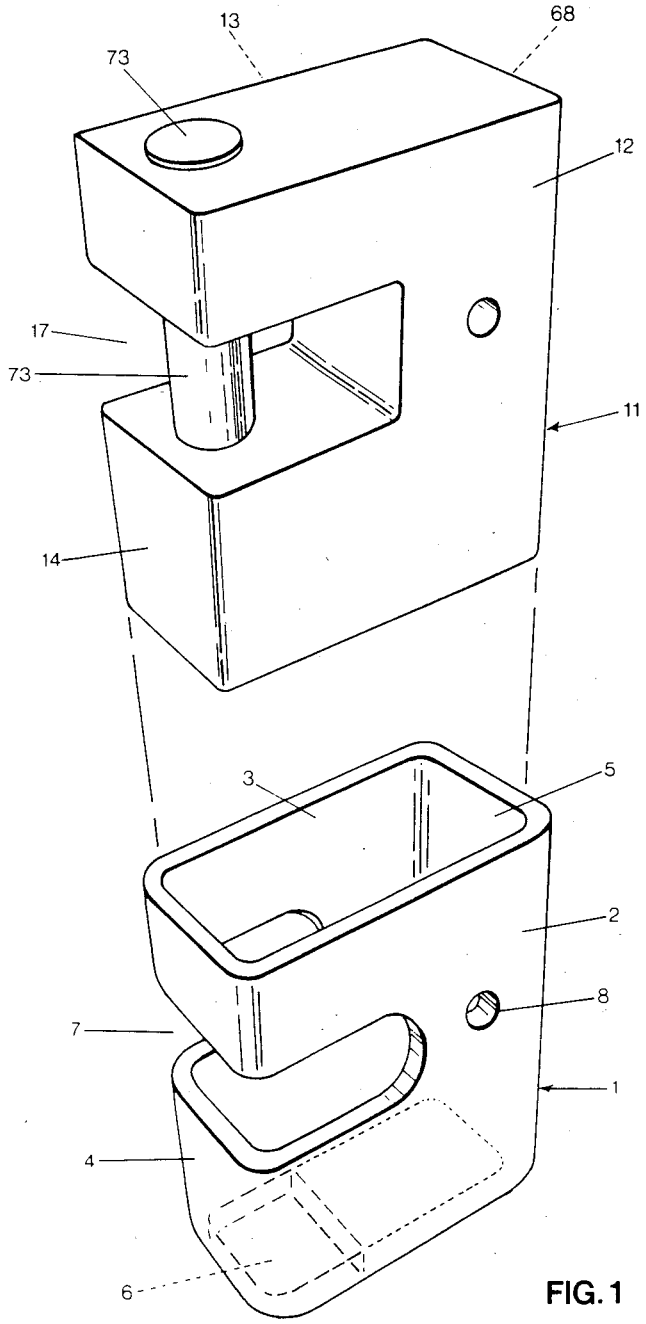
FIG. 1 is a perspective view of a general form of padlock housing for use in the invention, and a padlock of commercially available type for use therewith.
Figure 2:
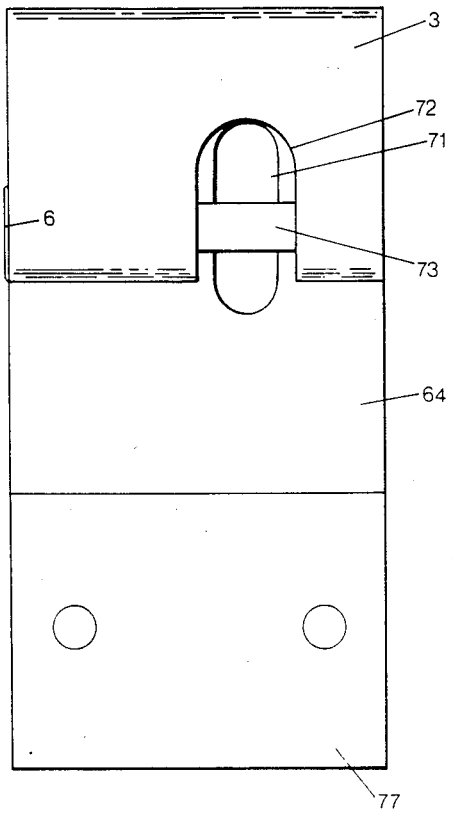
FIG. 2 is a rear view of one embodiment of a locking device according to the invention showing the closed padlock in position in the housing, but omitting the staple.
Figure 3:
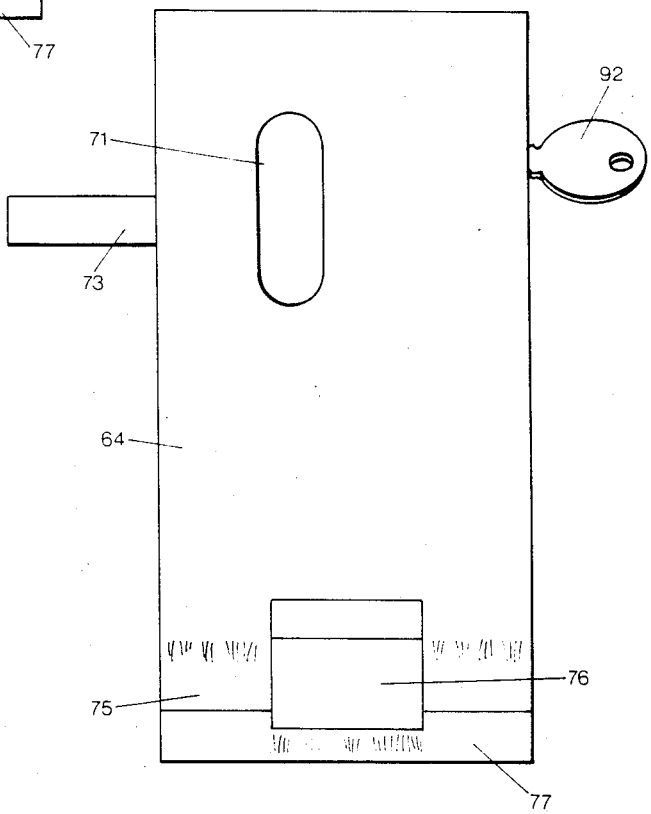
FIG. 3 is a front view of the device of FIG. 2, showing the padlock open.

As shown in FIG. 1, a padlock housing 1 for receiving and shielding a padlock 11 of rectangular paralleliped configuration comprises two wall portions 2, 3 corresponding to the two main parallel faces 12, 13 of the padlock, a foot portion 4 at right angles to said wall portions and corresponding to the recessed side face 14 of the padlock, and a bridge portion 5 parallel to the foot portion and corresponding to the closed side face 68 of the padlock. A guard plate 6 extends between the two wall portions 2, 3 adjacent to the foot portion 4.

Apart from this guard plate, the ends of the housing are open.

A slot 7 is cut through the foot portion 4 and extends into both of the wall portions in a position corresponding to the recess 17 in the padlock. In the padlock illustrated in FIG. 1, the arm of the padlock which contains the key-operated mechanism is longer than the other arm so that the slot 17 between the arms is offset from the centre line of the padlock. Consequently the slot 7 in the housing is not spaced equidistantly from the two ends of the housing but is spaced further from the end having the guard plate. However other padlocks (particularly the larger sizes) have two equal arms and in such a case the slot 7 would be spaced equidistantly from the two ends of the housing.

The housing is dimensioned such that the wall portions 2, 3 are separated by a distance which is marginally greater than the depth of the padlock and they have a width (from foot portion 4 to bridge portion 5) which is marginally greater than the width of the padlock so that the padlock is a sliding fit between the wall portions. The housing has a length from end to end which is equal to or marginally greater than the length of the padlock. Thus the housing has dimensions slightly greater than those of the padlock so that the padlock is received and shielded in the housing but can slide in and out.

In some embodiments of the invention, the bridge portion 5 is omitted. In some embodiments, also, one of the wall portions 2, 3 is formed by a part of a larger plate, such as a hasp plate.

Figure 4:
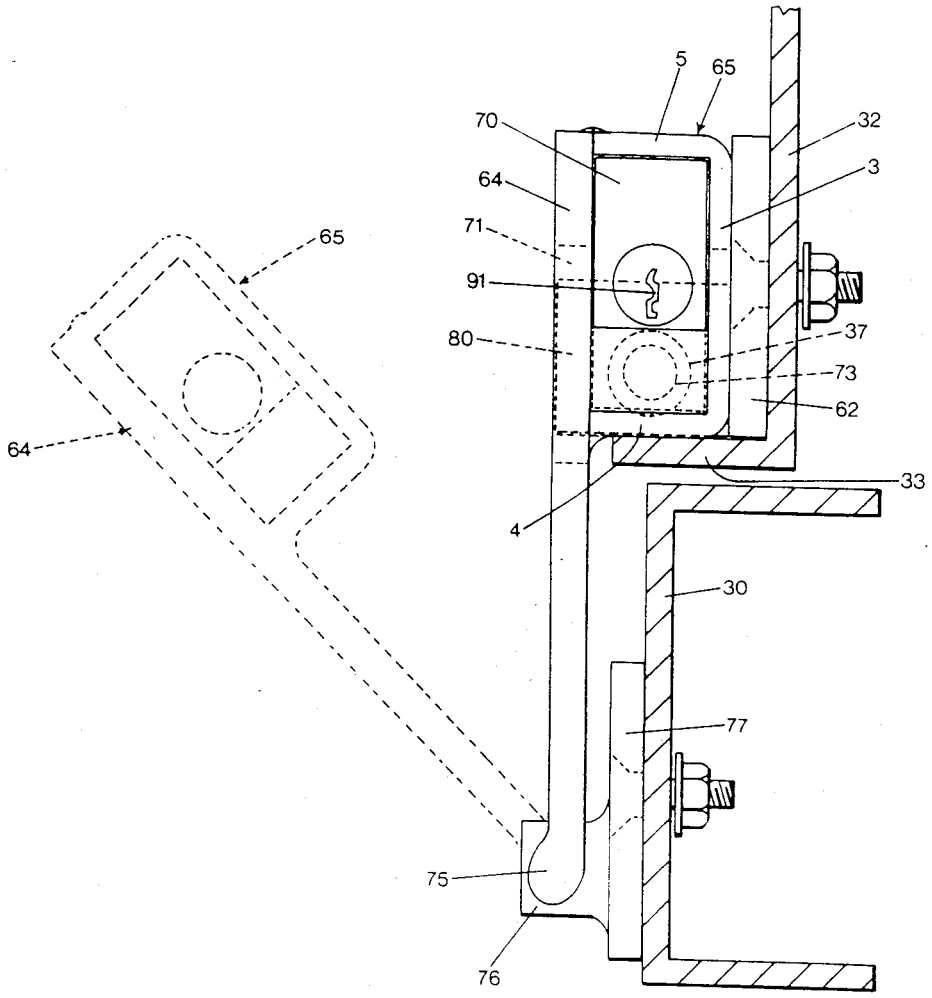
FIG. 4 is a sectional view of a fragment of a vehicle body with the locking device of FIGS. 2–4 in closed position thereon, and also showing in dotted outline the hasp in the course of being opened.
Figure 5:
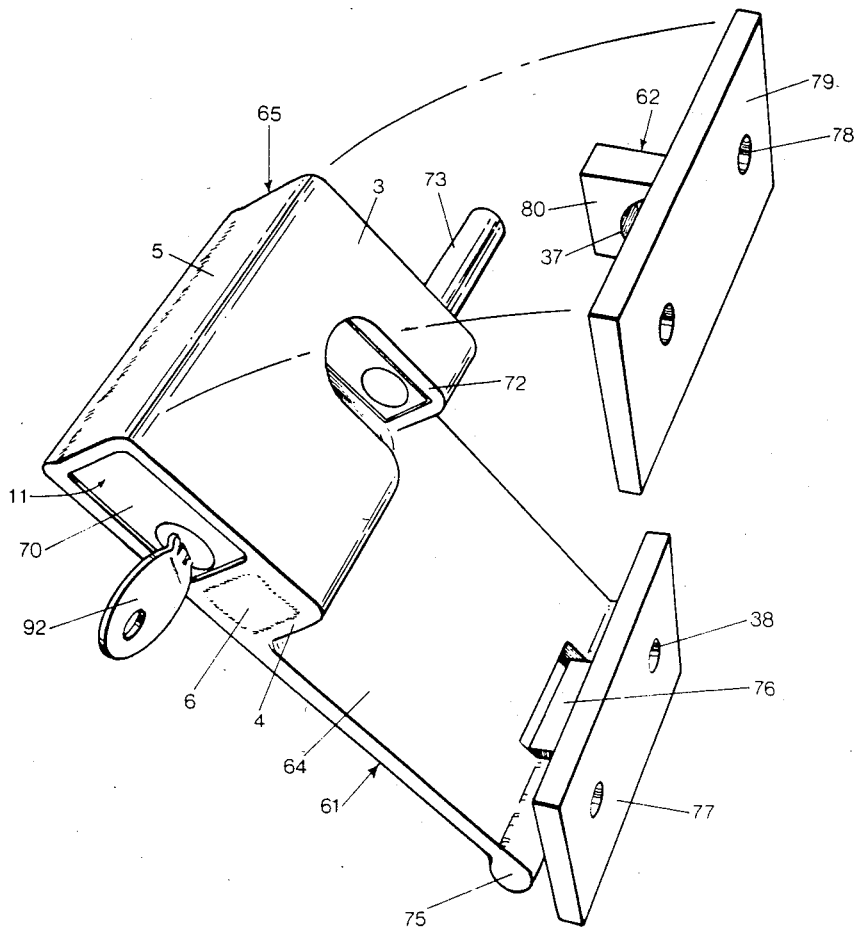
FIG. 5 is a perspective view of the locking device of FIG. 4 in the open position.

In the embodiment shown in FIGS. 2–5, the locking device comprises a hasp 61 and staple 62 secured by a padlock 11 (see FIG. 5). The hasp 61 comprises a flat metal plate 64 and a shield portion 65 which define between them a space of suitable dimensions to receive the padlock 11 which is a slide-bolt padlock of rectangular paralleliped configuration as described above.

The shield portion 65, which has a broad U-shape, comprises a foot portion 4, a wall portion 3 at right angles thereto and a bridge portion 5 parallel to the foot portion. The shield portion 65 can be made by bending a piece of mild steel plate and cutting a slot 72 which extends from the free edge of the foot portion 4, across the foot portion and around the corner into the wall portion 3. The free edges of the foot portion 4 and bridge portion 5 are welded to the flat hasp plate 64, a part of which forms the second wall portion of the padlock housing. The shield portion 65 can be of lighter gauge metal than the hasp plate e.g. a shield portion of 3 mm mild steel can be used with a hasp plate of 6 mm thickness.

The hasp plate 64 has a longitudinal slot 71 which intersects the junction between the hasp plate and the foot portion 4 of the shield portion 65. The slots 71 and 72 are aligned with each other and with the recess between the arms of the padlock 11, when it is located in the housing. The sliding bolt 73 of the padlock bridges this gap when the lock is closed, and extends from one end face 69 of the padlock when it is opened by means of a key 92 inserted in a keyhole 91 in the other end face 70.

The hasp plate and shield portion define a pocket, into which the padlock can be slid from one end. The other end of the housing is partly closed by guard plate 6 and this prevents the padlock from passing through the said other end. The padlock may be secured in the housing by a rivet or screw (inserted through a hole such as the hole marked 8 in FIG. 1), or it may be left free so that it can be removed from the housing when the locking device is not in use.

A pivot pin 75 welded to the base of the hasp plate (and offset slightly in the direction away from the shield portion) is journalled in a central hinge block 76, which is itself welded to a hinge plate 77 which may be screwed, bolted or rivetted through holes 38 to a vehicle framework or other base. The heads of the screws, bolts or rivets are covered by the hasp plate in the closed position. The staple 62 is bolted or rivetted through holes 78 in its base plate 79 to a second component of the item to be secured.

The base plate 79 of the staple is dimensioned so as to come into alignment with the hasp plate when the device is closed. The staple 62 enters the hasp through the slot 72 in the shield portion. The shackle 80 of the staple is not on the middle line between the two edges of the base plate parallel to the shackle, but is offset from said middle line to take account of the fact that the gap in the padlock 11 is nearer to end face 69 than it is to end face 70. The shackle 80 of the staple defines a generous opening 37 for the bolt 73.

FIG. 4 illustrates the use of the locking device of FIGS. 2–5 for securing roller shutters, particularly on delivery vehicles.

The staple 62 is fixed to the bottom angle section 32 of a roller shutter, which has a bottom flange 33 projecting forwardly. The staple is closely adjacent to the flange 33. The hinge plate 77 is bolted (or alternatively welded) to a vehicle frame member 30. When the device is closed (as in FIG. 4) the foot portion 4 of the hasp engages over the flange 33 for extra security.

When the device is unlocked, the padlock travels with the hasp (as shown in dotted outline in FIG. 4). When not in use the hasp and padlock hang down below hinge block 76, the padlock being retained in the housing. This is advantageous, particularly for vehicles, because it overcomes the problem of a padlock being lost if it is detached from the vehicle on every occasion when the shutter is unlocked. However, as already noted, the padlock can be slid out of the housing, if desired.

In the case of a delivery vehicle having several roller shutters, each shutter can be provided with a locking device according to the invention and similar padlocks may be supplied for all of the devices so that one key can open all of the locks.

The locking device of FIGS. 2–5 has utility in other areas apart from vehicles; for example in a window opening or door opening, the device may be used with the hinge plate 77 fixed to the face of a step or sill at the bottom of the opening.

Figure 6:
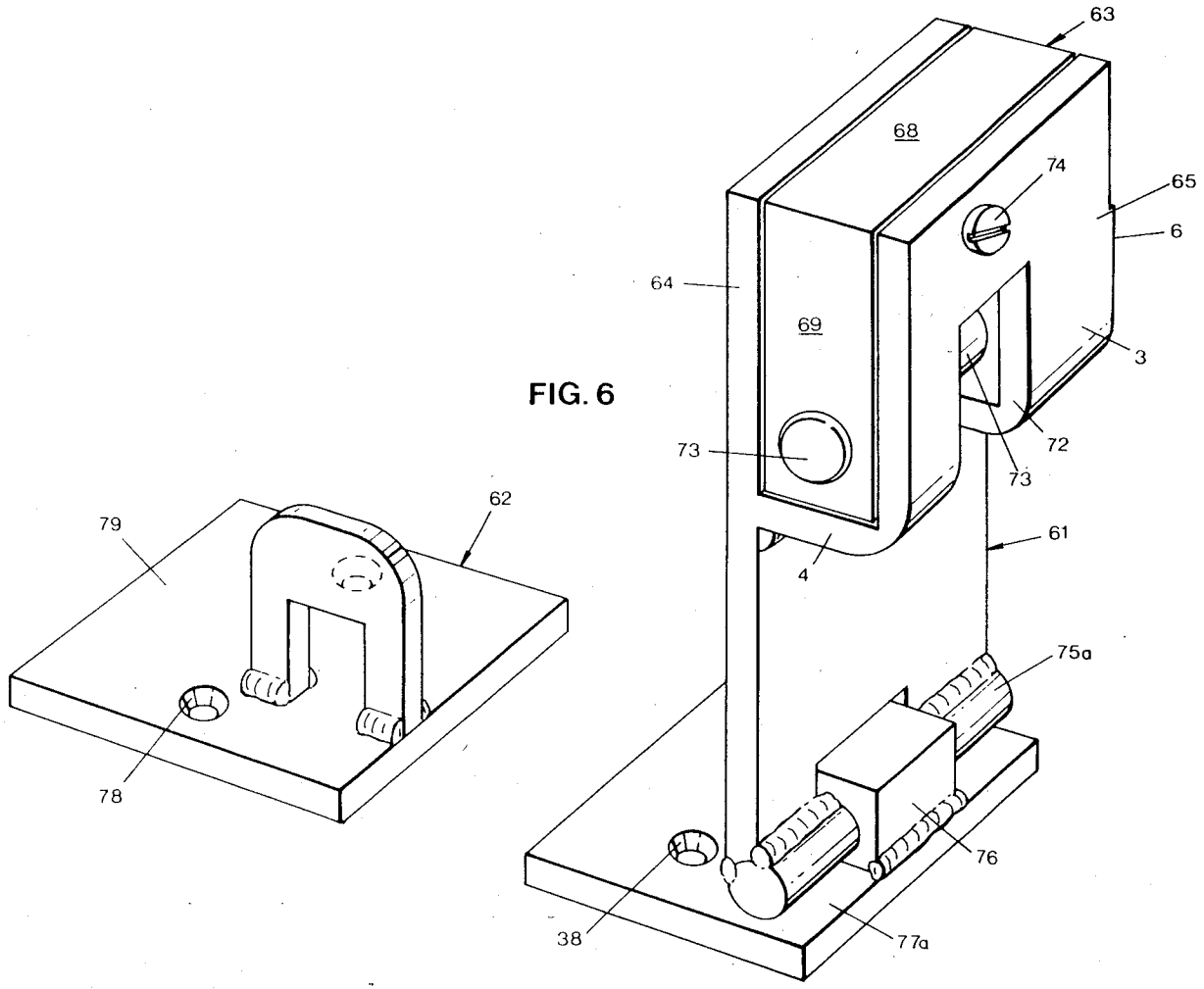
FIG. 6 is a perspective view of a second embodiment of a locking device according to the invention, with the hasp and padlock unit shown at right angles to a hinge plate and staple.
Figure 7:
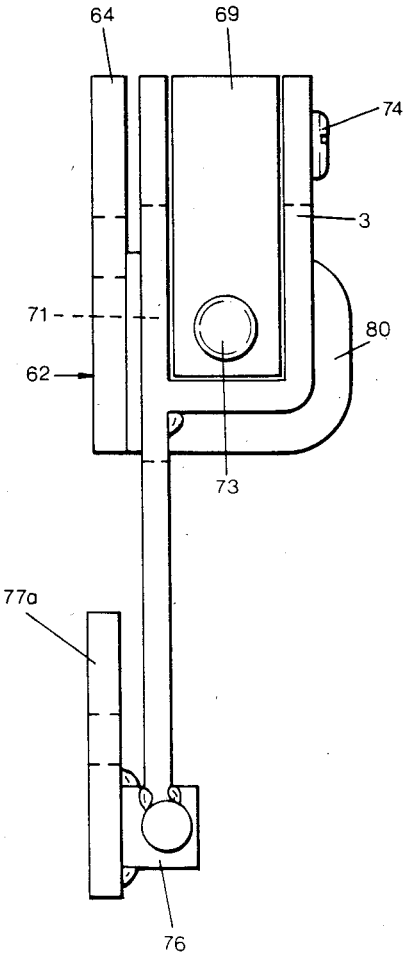
FIG. 7 is one end view of the device of FIG. 6 in closed position.
Figure 8:
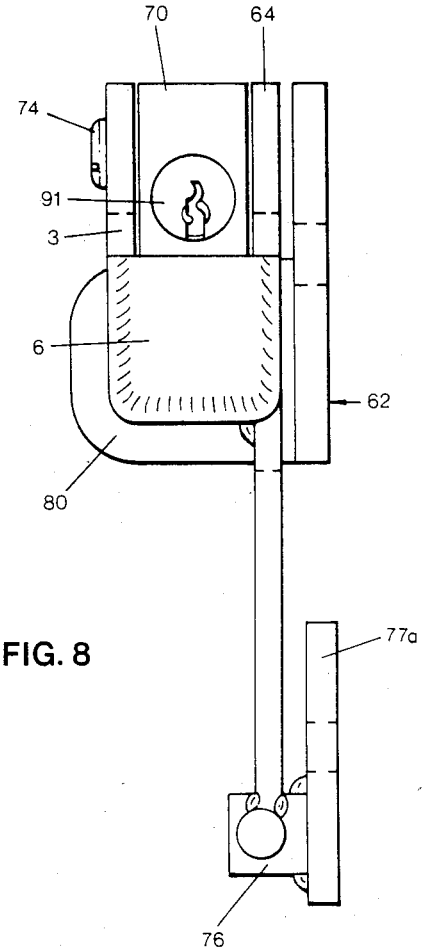
FIG. 8 is the other end view of the device of FIG. 6 in closed position.

The embodiment shown in FIGS. 6–8 is similar to that of FIGS. 2–5, and the same reference numerals are used for similar parts.

In this embodiment the bridge portion 5 of the housing is omitted and the shield portion 65 is therefore of L-shaped cross section, the free end of the wall portion 3 being level with the end of the hasp plate 61. The side face 68 of the padlock is exposed but it is not vulnerable to tampering because it is a closed face. The padlock is held in the housing by a screw 74 forced into a hole of slightly smaller diameter and passing through a solid brass portion of the padlock.

In another variation from FIGS. 2–5, the hasp plate is mounted to swivel in the opposite sense on the hinge plate 77*a* and the pivot pin 75*a* is offset slightly in the direction of the shield portion. The staple 62*a* enters the hasp through the slot 71 in the hasp plate 61. The hinge plate 77*a* and the base plate 79 of the staple are usually fixed in the same plane (subject to adjustment using packing pieces). This locking device is of general utility for doors, gates, etc.

In an alternative embodiment (not shown), the housing has a bridge portion 4 formed by bending the hasp plate at right angles at its free end, so that it meets the free end of the wall portion 3.

FIGS. 9–12 show a locking device according to the invention incorporated into a "ground lock" for securing the leading edge of a roller shutter to the ground. Similar locks can be used for securing the leading edge of a door (particularly a sliding door or "up and over" cantilever door). Instead of the ground, the base can be a floor or sill or frame member, including a vertical frame member if the shutter or door is horizontally slidable rather than vertically slidable.

FIGS. 9–12 show a receiver link 39 of the kind described in Irish Patent Application No. 2845/81 (British Patent Application No. 2,111,586 A). This receiver link has a spindle for engagement with an anchorage sunk into the ground, and a staple portion 51 having an aperture 56 for receiving the bolt of a padlock.

The receiver link cooperates with an abutment member 40 secured to the leading edge of a shutter 21.

The abutment member 40 is designed to accommodate a sliding bolt padlock 41 of rectangular paralleliped configuration.

The abutment member 40 comprises a fixing portion 42 at the rear, a hasp portion 43 at right angles thereto and two parallel wall portions 44, 45 at right angles to the hasp portion. The fixing portion 42 is secured through fixing holes 57 by a pair of bolts 15 and nuts 16 to the vertical portion of the bottom angle section of shutter 21. The bolt head can be welded in position. One wall portion 44 is located at the forward edge of the hasp portion. The fixing portion 42, hasp portion 43 and forward wall portion 44 are conveniently formed of one piece of steel plate bent into U-shape. The inner wall portion 45, which is located approximately midway between the forward wall portion 44 and the fixing portion 42, comprises a piece of steel plate welded to the hasp portion 43. The two wall portions 44, 45 are both approximately equal in height to the main faces 46, 47 of the padlock 41, and are separated by a distance which is marginally greater than the width of the padlock, so that the padlock is a sliding fit between the wall portions. The abutment member has a length which is marginally greater than that of the padlock. Thus the wall portions 44, 45 and a part of the hasp portion 43 equivalent to the foot portion 4 in FIG. 1 define a housing having dimensions roughly equal to those of the padlock so that the padlock is received and shielded in the housing.

The hasp portion 43 and forward wall portion 44 are penetrated by a slot 48 which is offset with respect to the middle of the abutment member so that it comes into alignment with the slot 49 in the padlock. The slot 48 extends behind the inner wall portion 45. If necessary, a shallow indentation may be cut in the forward edge of the shutter flange 18 so as to register with the rear edge of slot 48. A coincident slot 50 is provided in the inner wall portion 45, similar to that in forward wall portion 44. The space created by the slots 48, 49, 50 is dimensioned so as to receive the staple portion 51 of the receiver link in said slots with good tolerance for moving the staple portion 51 within the said space, in order to adjust for variations in the relative positions of the shutter and the anchorage. The staple portion 51, in this particular embodiment, does not fit between the two wall portions but is accommodated by the slots 48 and 50 in the wall portions (see FIGS. 11 and 12).

Figure 11:
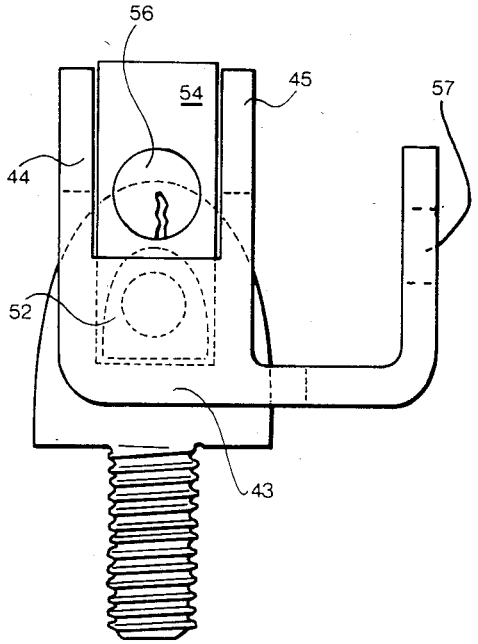
FIG. 11 is one end view of the abutment member in the embodiment of FIG. 9, showing the padlock and receiver link.
Figure 12:
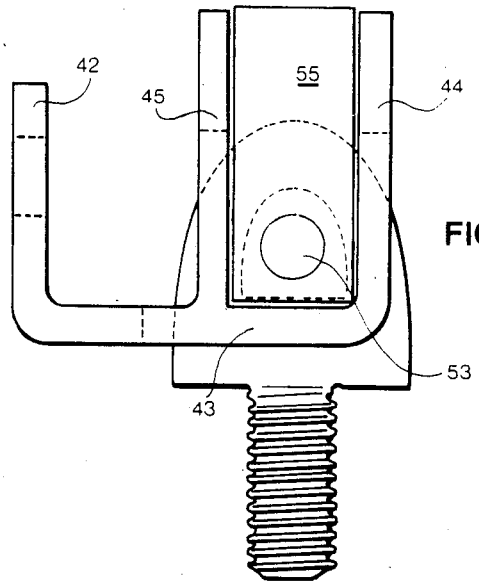
FIG. 12 is the other end view of the abutment member of FIG. 9.

As shown in FIG. 11, one end of the abument member is provided with a guard plate 52 which bridges the lower parts of the two wall portions 44, 45 and is welded to said wall portions and to the hasp portion 43. The guard plate 52 strengthens the structure of the wall portions and prevents bolt 53 of the padlock being driven out through end face 54 of the padlock by a person hammering on the exposed end of the bolt at the other end face 55. Due to the offset position of the slot 49, there is only one correct orientation of the padlock in the housing. The keyhole 56 of the padlock is accessible above the guard plate 52 and, by virtue of the upright position of the padlock, is spaced sufficiently far from the ground surface for convenient operation of the key without contact between the operator's hand and the ground.

The space between the inner wall portion 45 and the rear fixing portion 42 can be used to accommodate the padlock 41 if there is a need to store it in a position where it does not engage with the staple portion 51. The separation of the inner wall portion 45 from the rear fixing portion 42 is sufficient for bolts 15 to be introduced at either end of the abutment member into the fixing holes 57. The bolts are suitably coach bolts having a stock portion of square cross-section between the head and the threaded shank. The fixing holes have a diameter which is larger than that of the shank but marginally smaller than the diagonal dimension of the square stock portion (for example, in the case of a hole having a shank of 10 mm diameter and a stock portion with a diagonal dimension of 13.5 mm, a fixing hole of 12.5 mm is suitable). Then as nut 16 is tightened on the bolt, at the rear of the shutter, the corners of the square shank portion cut into the metal around the fixing hole and when the bolt is fully installed it is gripped firmly against rotation. This minimises any risk of the bolts being loosened from the front of the shutter. Coach bolts are also used in this way in other embodiments of the invention.

Figure 9:
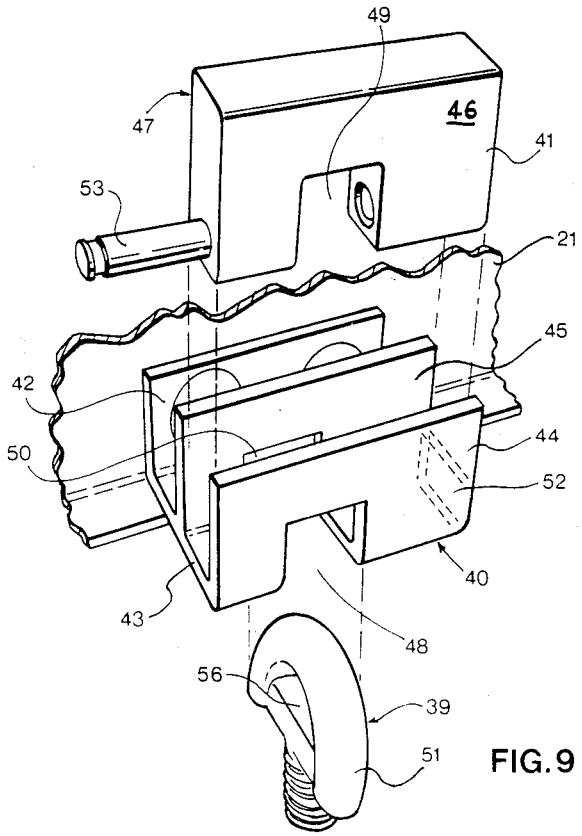
FIG. 9 is an exploded perspective view of a third embodiment, for a "ground lock" for a shutter.
Figure 10:
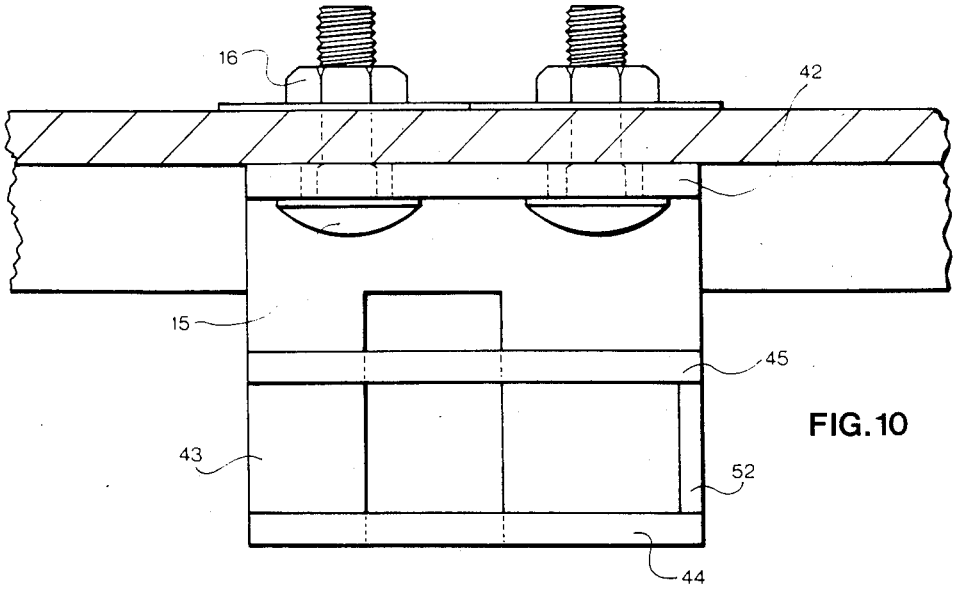
FIG. 10 is a plan view of the abutment member in the embodiment of FIG. 9.

When a shutter is being closed, for example at night, the leading edge of the shutter is brought down to about waist level and the padlock is opened by a key inserted in keyhole 56 and the bolt 53 springs out to the position shown in FIG. 9. If the shutter has two or more similar locking mechanisms, the padlocks can be chosen such that a single key opens all of them. The receiver link is engaged into its anchorage and the leading edge of the shutter is lowered again until the staple portion 51 enters the space provided by slots 48 and 50.

Padlock 41 is placed into its housing between wall portions 44 and 45 and is closed so that the bolt 53 bridges slot 49 and engages in the aperture in the staple portion 51. The padlock is shielded on three faces by wall portions 44, 45 and hasp portion 43. It cannot be slid endways or lifted upwards because of the engagement of the staple portion 51 with the bolt 53.

When the shutter is to be opened, the padlock is opened by the key and the padlock is then preferably lifted up out of its housing. The bolt can be closed (out of engagement with staple portion 51) and the key can be used to open one or more similar padlocks. The shutter is raised to about waist height; the padlock 41 is restored to its housing; the receiver link is disengaged from its anchorage and inserted into the space provided by slots 48, 49, 50; the bolt 53 is closed to retain the receiver link in a storage position; and the shutter is raised to its fully open position.

The padlock, and particularly its slotted face adjacent to the bolt, is shielded from tampering by its housing.

If desired, the padlock can be secured in position in the housing, e.g. by rivet or bolt. However it is preferred to leave the padlock free so that it can be lifted out of the housing in the manner described above, and also so that it can be taken away for maintenance of the lock mechanism, or for replacement if keys are lost or compromised, e.g. with reason to believe that they have been duplicated.

Figure 13:
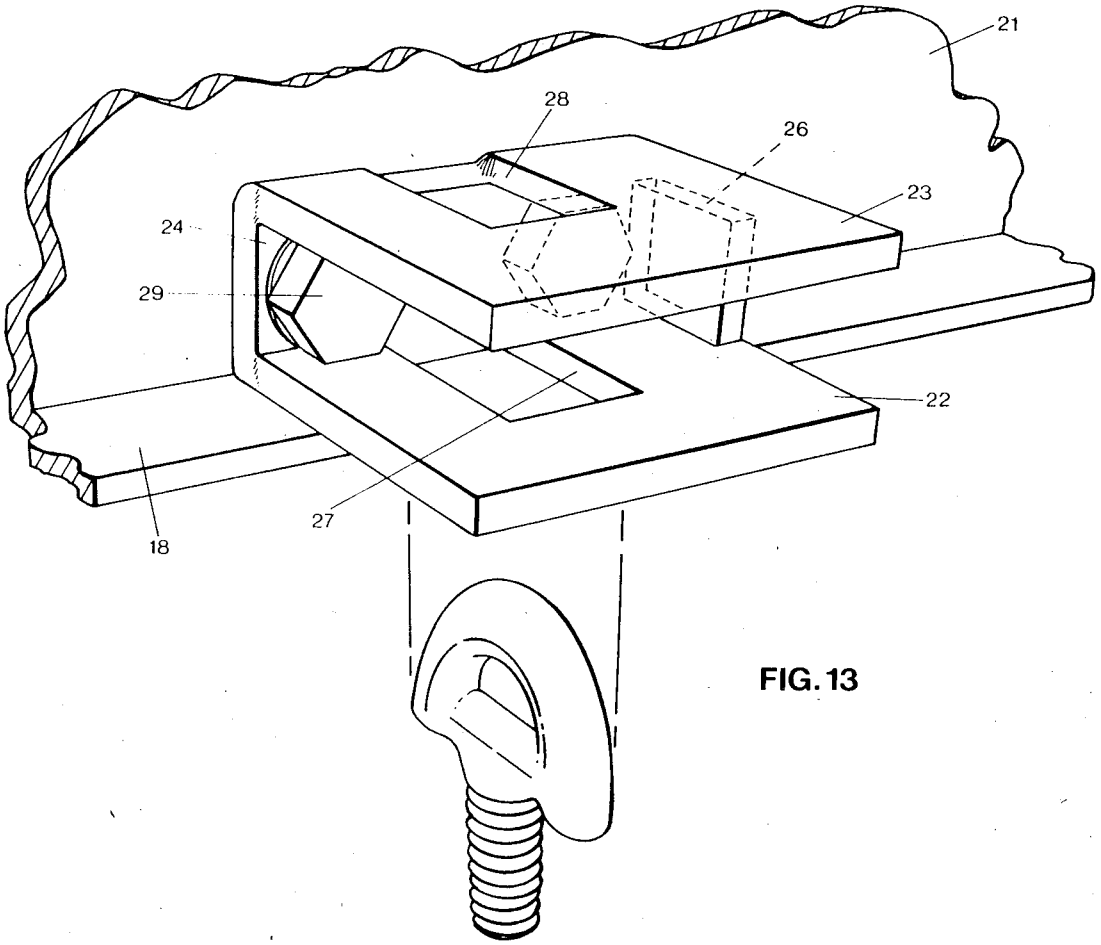
FIG. 13 is a perspective view similar to FIG. 9 of a fourth embodiment, being an alternative form for a "ground lock"

FIG. 13 shows an alternative abutment member for a ground lock. The padlock housing has been turned through 90° as compared to the embodiment of FIGS. 9–12.

The housing comprises wall portions 22, 23 and a foot portion 24, with a guard plate 26. Slots 27, 28 are cut through the two wall portions. The foot portion 24 is secured to the bottom angle section of shutter 21 by means of bolts 29, whose heads are accomodated in the housing between foot portion 24 and the padlock (which is not shown but which is a padlock of rectangular paralleliped configuration as described previously). No slot is required in the foot portion 24 of this embodiment. An indentation is cut in the shutter flange 18 in line with slot 27.

The staple portion 51 of the receiver link enters slot 27 and is secured therein by the bolt of a padlock in the same manner as described above.

FIGS. 14–17 show a security post assembly incorporating a locking device according to the invention.

Figure 14:
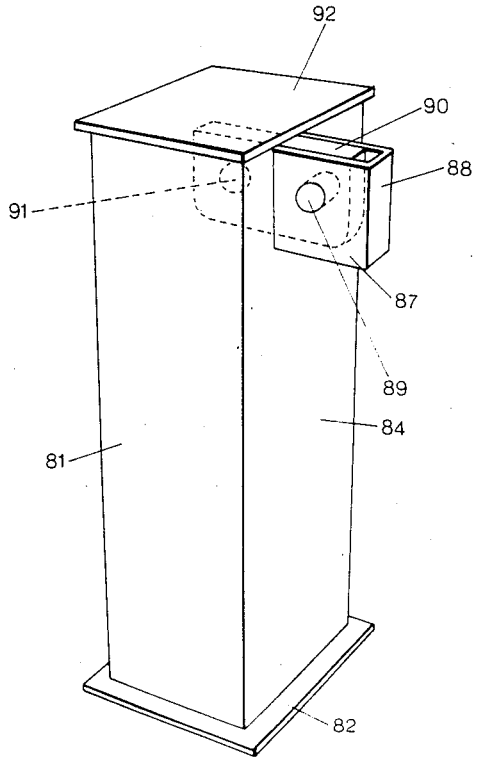
FIG. 14 is a perspective view of a base tube for a removable security post, shown in the closed position.
Figure 15:
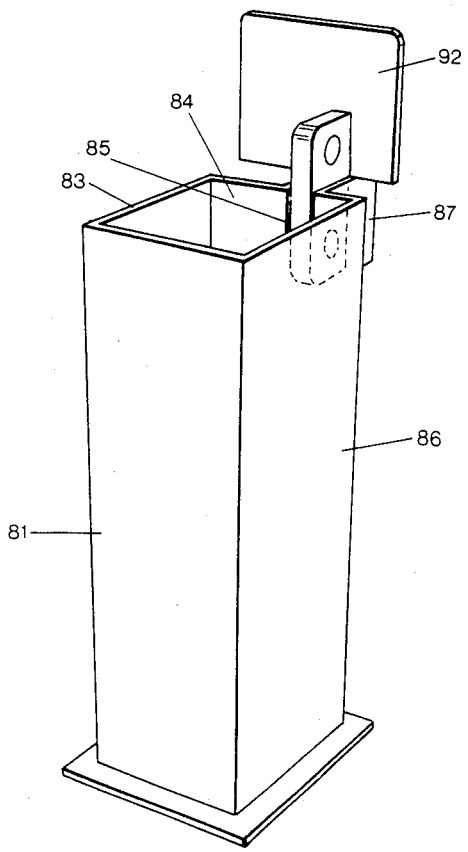
FIG. 15 is another perspective view of the tube of FIG. 14, shown in the open position.

As shown in FIGS. 14 and 15, a base tube 81 comprises a hollow rectangular steel tube having a flange 82 at the bottom thereof. In use the base tube is sunk securely into the ground or other base, such as concrete, tarmac etc., so that the mouth 83 of the tube is level with the ground or other base.

One side wall 84 of the tube has a slot 85 cut downwardly from the mouth 83. The slot is not in the middle of the side wall 84, but is offset towards one end wall 86. On the two edges of the slot 84 support brackets extend outwardly, at right angles to side wall 84. The outer edges of the support brackets are bridged by an end plate 88.

A pivot axle 89 is journalled in the two brackets 87. The pivot axle may be a bolt held in position by a nut, or a pin held by welded or rivetted heads. Rotatably mounted on the axle 89 there is an arm 90 which is penetrated by two transverse apertures, one aperture being to receive the axle 89 and the other aperture being a locking aperture 91 which is parallel to the axle aperture. Sufficient gap is provided between the arm 90 and the end plate 88 for rain water, stones, earth, etc. to pass around and beneath the arm and so to reach the inside of the base tube 81.

A rectangular cover plate 92 is welded to the arm 90 with its principal plane parallel to the axle 89. The cover plate is dimensioned and located so as to fit on top of the mouth 83 of the base tube 81 when the plate is in its covering position, as shown in FIG. 14.

Figure 16:
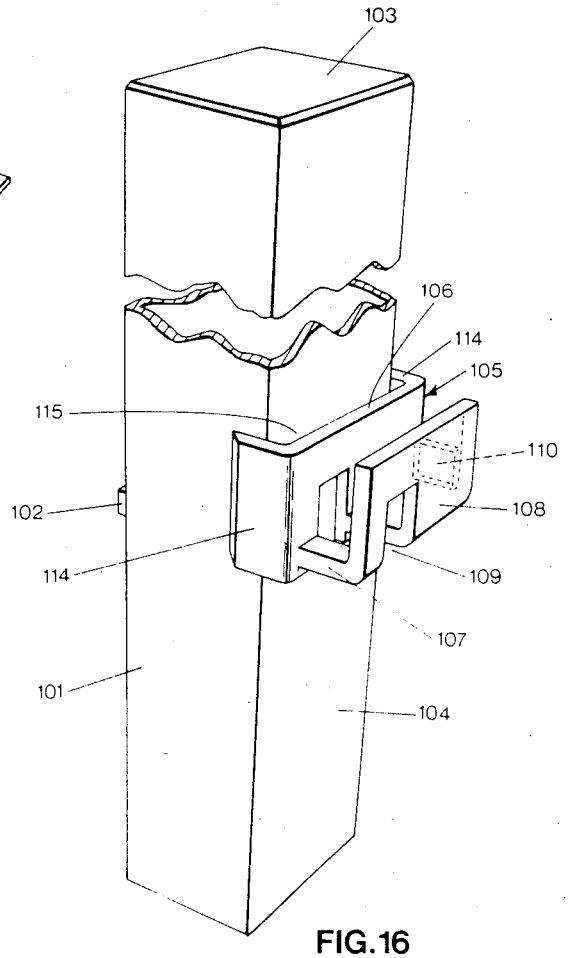
FIG. 16 is a perspective view of a security post having a padlock housing in accordance with the invention.

As shown in FIG. 16 the post 101 comprises a rectangular steel tube which is dimensioned to fit closely within the 83 of the base tube 81 so that it is supported in a vertical position. A stop 102 prevents the post 84 from passing down too far into the base tube 81. The post has a closed top 103, although this is not essential.

Fixed to one side wall 104 of the post, there is a padlock housing 105. The housing comprises a back wall portion 106 and an L-shaped shield portion comprising a foot portion 107 at right angles to the back wall portion and a front wall portion 108 which is parallel to the back wall portion. At each end of the back wall portion 106 there is a flange 114 extending rearwardly to embrace the post 101. The flanges 14 are welded to the post, leaving a gap 115 between the post and the back wall portion 106. A slot 109 penetrates the foot portion 107 and extends most of the way up the back and front wall portion 106 and 108. The slot 109 is offset from the midline of side wall 104, in a corresponding alignment to the arm 90. A guard plate 110 bridges the back and front wall portions 106 and 108 for part of their height up from foot portion 107.

Figure 17:
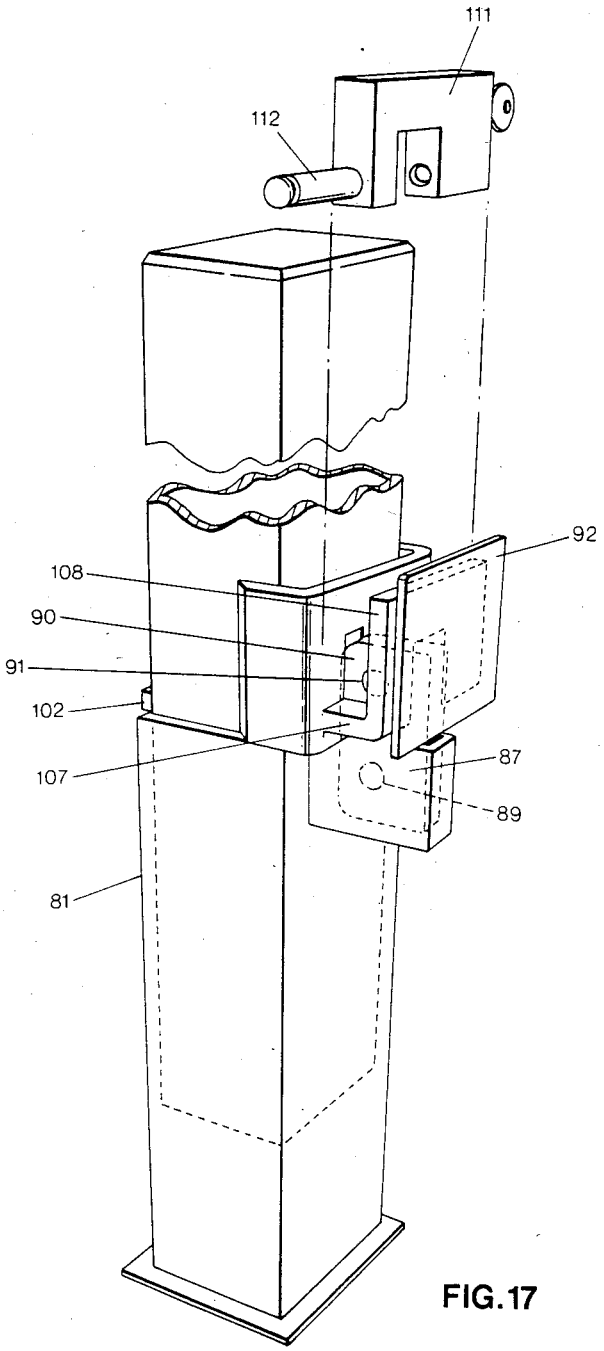
FIG. 17 is a perspective view of the base tube and post of FIGS. 14–16, when assembled.

When the post 101 is to be inserted into the base tube 81 (as shown in FIG. 17) the cover plate 92 is lifted from the mouth of the base tube and swivelled about the pivot axle 89 until the cover plate is in a vertical plane with its lower edge resting on the top of the support brackets 87. The post is then inserted into the mouth of the base tube 81 until the stop 102 rests on top of the base tube 87 and the foot portion 107 of the padlock housing rests on the support brackets 87. The arm 90 enters the slot 109. The cover plate 92 now stands beside the post 101 but separated therefrom by a space which is occupied by the padlock housing 95; the cover plate 92 is face-to-face with the front wall portion 108 of the padlock housing.

A slide bolt padlock 111 of rectangular paralleliped configuration is installed in the housing which is dimensioned to receive the padlock neatly in the same manner as described previously. The back and front wall portions 106, 108 of the housing are of approximately equal height and length to the main faces of the padlock and are separated by a distance which is marginally greater than that of the padlock, so that the padlock is a sliding fit within the housing. If desired the padlock may be retained in the housing by a rivet or screw. When the padlock is being closed, bolt 112 is passed through the locking aperture 91 in the arm 190. The post cannot thereafter be withdrawn from the base 81 until the padlock is opened again. In this embodiment the padlock housing does not have a bridge portion closing the top of the housing. If the post is inserted into the tube with the padlock in the housing and with the bolt closed, the padlock is pushed up out of the housing when the bolt strikes the arm 90. If the top of the housing were closed, the padlock could not move upwards and so might be damaged by the impact.

The padlock is shielded against tampering or damage by the housing 105 and the cover plate 92. The guard plate 110 prevents the bolt 112 being driven out through the end face 113 of the padlock. The arm 90 is inaccessible inside the support brackets 87 and the housing 105. The parts of the locking device are simple and robust. In the event of a padlock being damaged, it can be replaced easily.

If desired, the post assembly may be used as an additional security device in front of premises protected by a roller shutter or door. In this case, an additional lug may be fixed on one side of the post to co-operate with an abutment member on the bottom of the roller shutter or door. This arrangement can be used instead of a "ground lock" of the kind described in Irish Patent Application No. 2845/81 (British Patent Application No. 2,111,586 A). For example, the abutment member may be of the kind shown in FIGS. 9–12 herein or it may have a padlock housed between horizontal wall portions as shown in FIG. 13 herein. The lug may project from the tube on a horizontal bracket and may have an upstanding staple portion to enter a slot in the abutment member and to co-operate with the padlock.

The elements of the security post assembly are preferably zinc electro-plated steel.

Figure 18:
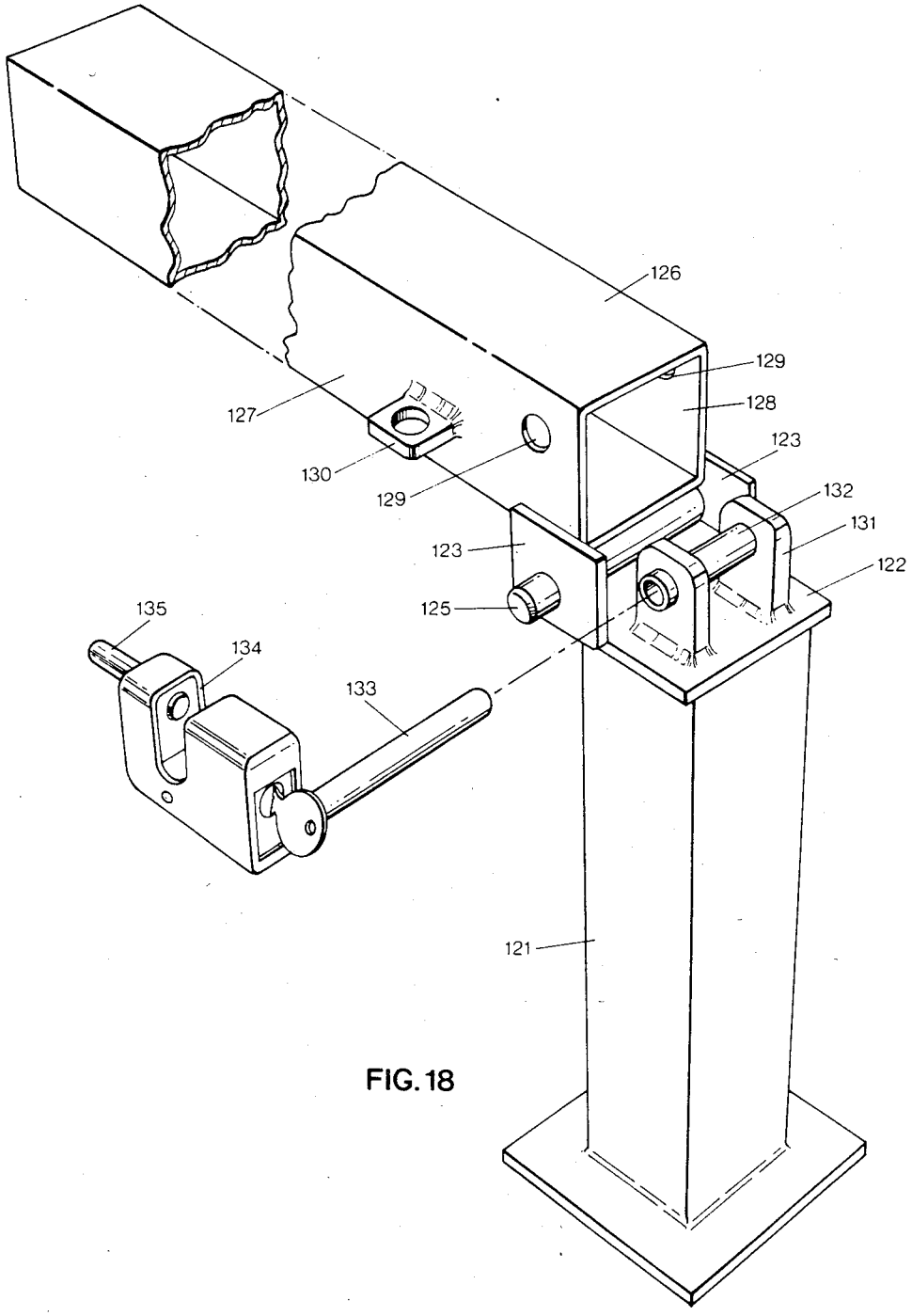
FIG. 18 is a perspective view of another form of security post, shown in the folded position with the locking device in exploded relationship.
Figure 19:
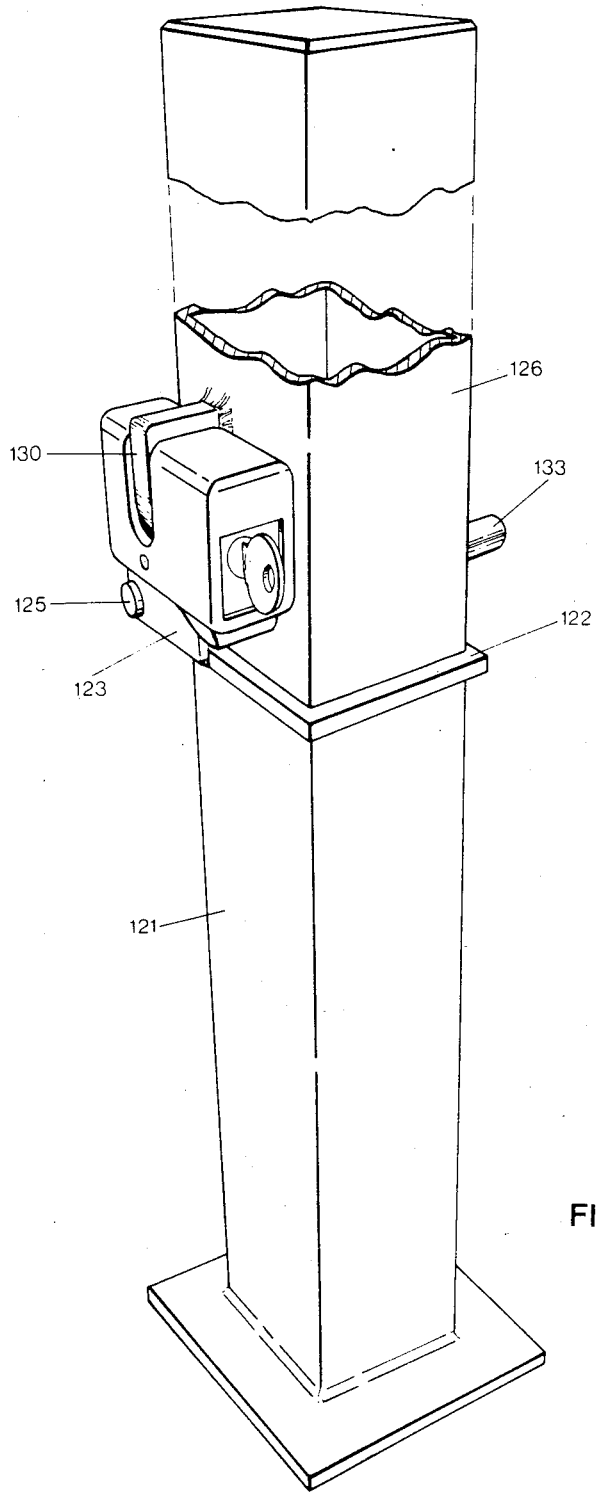
FIG. 19 is a perspective view of the post of FIG. 18 in the assembled and locked position.

FIGS. 18 and 19 show an alternative security post assembly in which the post is not removable from the base tube but is hingedly attached thereto and can be folded down into a non-operative position (see FIG. 18).

The base tube 121 is closed at the top by a fixed cover plate 122 which lies at ground level and extends rearwardly from the tube. Welded at the side edges of the corner plate, at the rear thereof, are two flanges 123 having apertures in which a steel pivot rod 125 is journalled. A post 126 is welded at its bottom edge to the rod 125. Each of the side walls 127, 128 of the post is penetrated by a hole 129. Side wall 127 also carries a staple 130 welded thereto.

Near the front of the cover plate 122 there are two upstanding lugs 131 having apertures in which a steel tube 132 is secured. The lugs and tube are located and dimensioned such that they fit inside the post 126, when it is erected vertically by pivoting with the pivot rod 125, and the tube 132 is then aligned with the holes 129.

A locking device comprises a padlock housing of the kind shown in FIG. 1 having a steel locking rod 133 welded to the bridge portion 5 thereof and extending at right angles to one wall portion thereof. The locking rod is of slightly smaller diameter than the internal diameter of holes 129. The padlock is held in the housing by a self tapping screw but this screw can be removed and the padlock can slide out of the housing for repair or replacement.

When the post is in the vertical position of FIG. 19, the locking rod 133 is inserted through aligned holes 129 and tube 132. The staple 130 enters the slot 134 in the padlock housing and in the padlock, whereupon the bolt 135 of the padlock is pushed through the staple 130 to lock the post in the upright position. The padlock housing lies tightly against the post and it cannot be pivoted about the staple, so that unscrupulous persons would have considerable difficulty in tampering with it.

Figure 20:
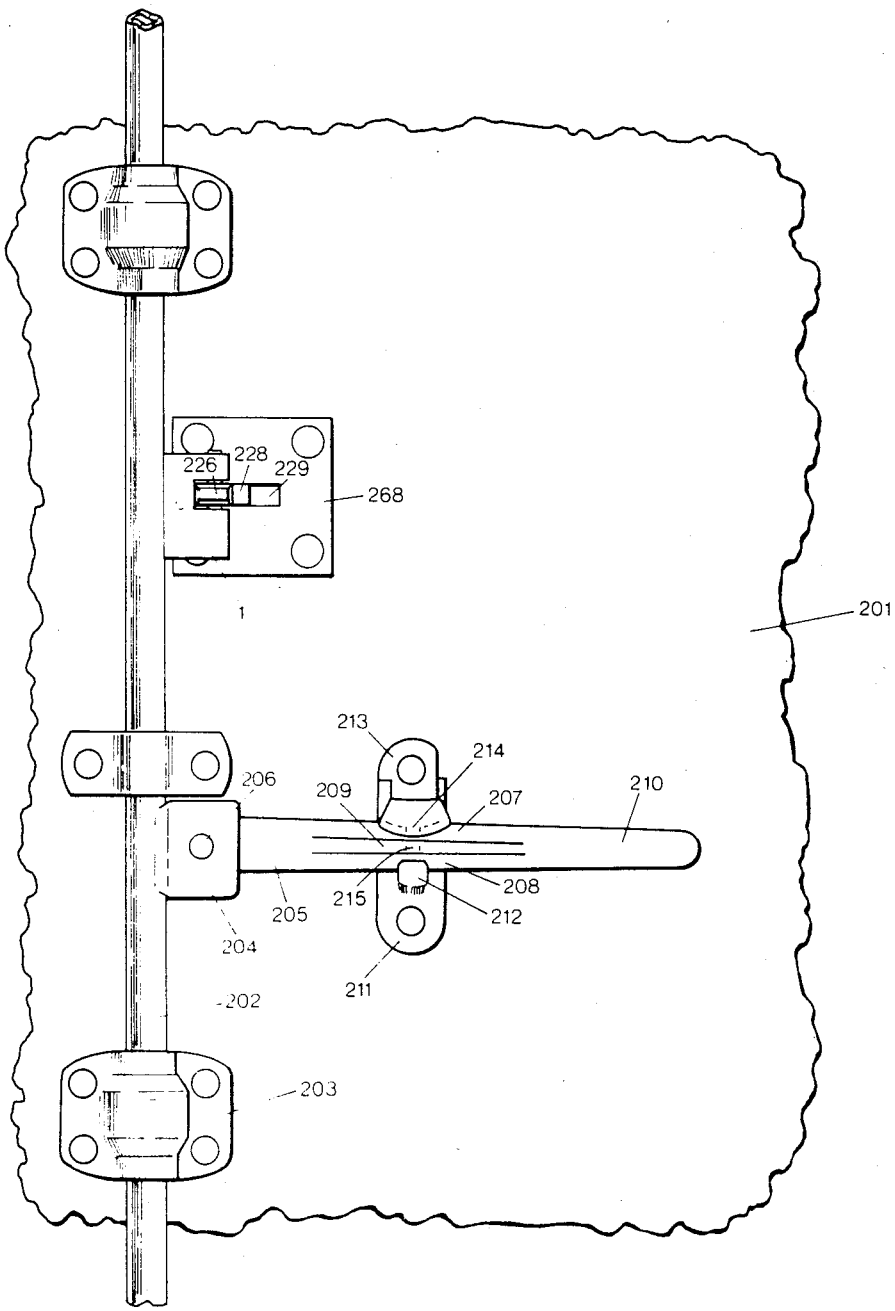
FIG. 20 is an elevation of a fragment of a vehicle door equipped with a twistable-rod locking mechanism incorporating a locking device according to the invention; the mechanism is shown in the closed position.
Figure 21:
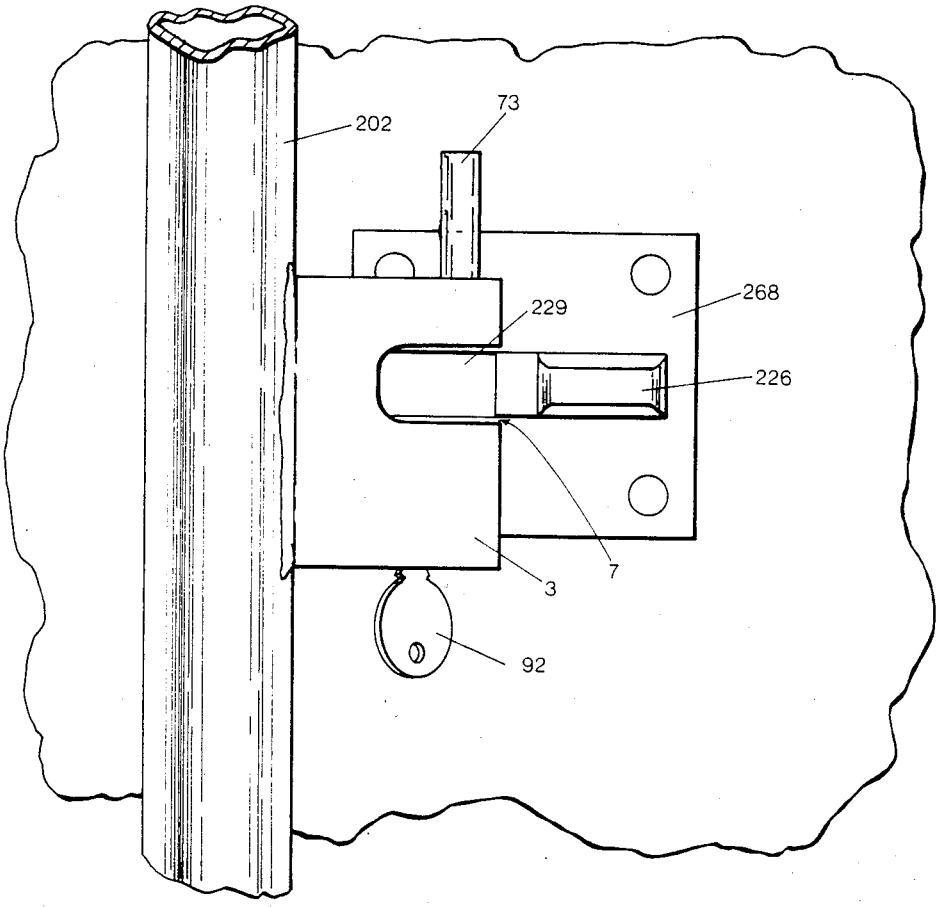
FIG. 21 is an enlarged elevation of the locking device of FIG. 20, shown in the open position.
Figure 22:
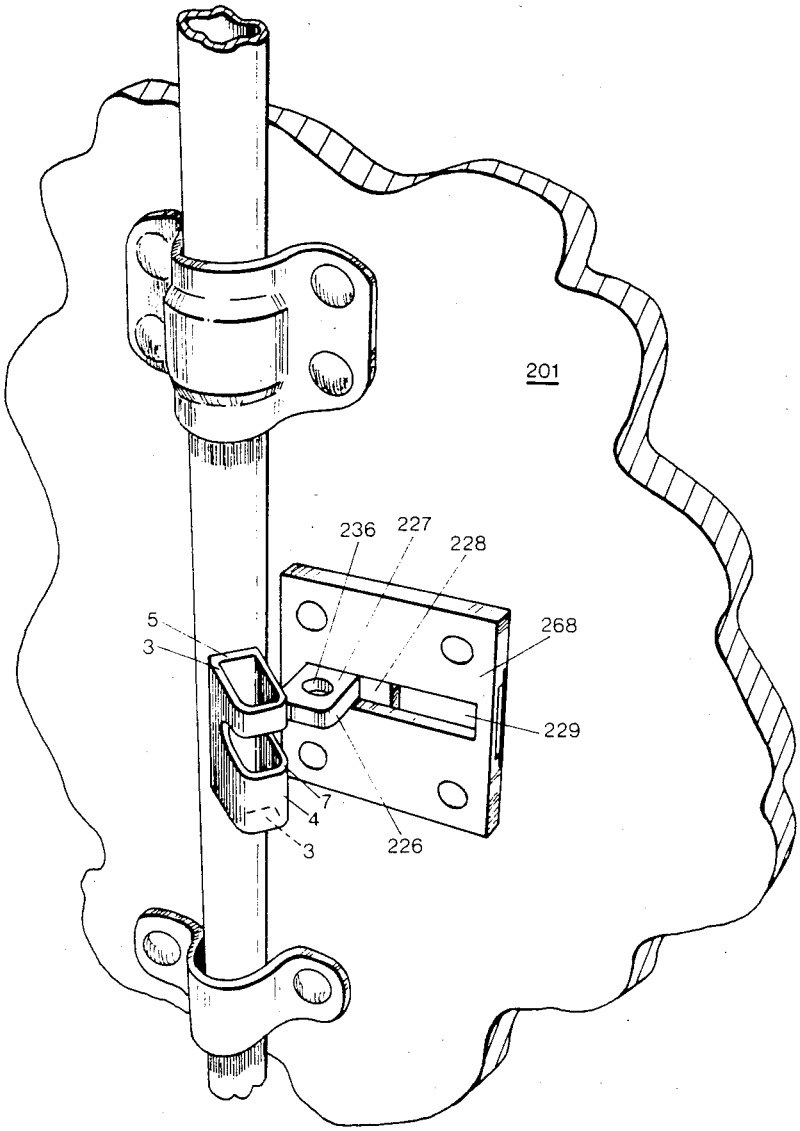
FIG. 22 is a perspective view of the locking device of FIG. 20, shown in the open position after the rod has been twisted and the padlock has been removed from the housing.

FIGS. 20–22 show a locking system for a cargo door 201 having a vertical locking rod 202 which can be twisted about its axis to engage or disengage locking elements at the top and bottom of the rod (not shown). The rod is rotatably mounted in saddle brackets 203.

A conventional locking device for a locking system of this kind is shown in FIG. 20. It comprises a U-shaped bracket 204 welded to the rod 202 and a bar 205 pivotably mounted on a pivot pin 206 whose ends are journalled in the arms of U-shaped bracket 204. The central portion of the bar 205 has upper and lower lips 207, 208 and a platform 209 extending forwardly. The outer portion of the bar 205 is formed as a handle 210.

Secured to the door 201 is a plate 211 from which a right-angled lug 212 projects. Pivotally mounted at the top of plate 211 there is a flap 231 whose free end is formed into a U-shape. The base of this U-shape is penetrated by a hole 214 which is aligned with another hole 215 in the platform 209, when the device is in the closed position. A conventional padlock shackle can be passed through the holes to lock the device.

However this padlock is exposed and is vulnerable to damage and to tampering.

To open the door, the flap 213 is rotated away from engagement with upper lip 207 of the bar 205, and the bar is raised until lower lip disengages from lug 212. The handle 210 can then be swung out to twist the rod 202.

In the locking device according to the invention, a padlock housing 1 of the kind shown in FIG. 1 is secured to the rod 202. The housing comprises two wall portions 2, 3 and a foot portion 4, all formed from a steel plate bent into a U-shape, plus a bridge portion 5 of slightly heavier gauge steel plate.

A slot 7 is cut into the foot portion 4 and part of each of the wall portions 2, 3. The bridge portion 5 is welded against the face of the twistable rod, parallel to the axis of the rod. The vertical mid-line of the bridge portion can be aligned with the axis of the rod, or it can be offset forwardly or backwardly relative to the axis, within the limits of the width of the bridge portion. Thus when the housing is being welded to the rod, the welder places the bridge portion against the rod and then adjusts it forwardly or rearwardly until the wall portion 2 of the housing is spaced from the door by a distance equal or marginally greater than the thickness of the mounting block 268 of the staple 226 (described below).

A slide-bolt padlock of rectangular paralleliped configuration is received neatly inside the housing and can be secured therein by a rivet through aperture 8. However if desired the padlock can be dropped into the housing and removed therefrom, as required.

For example, a particular driver may have his own padlock which he inserts into the padlock housing of any vehicle which he is driving and he uses his own key to open the padlock.

The staple 226 (see particularly FIG. 23) comprises an apertured projecting portion 227 and an anchor plate 228 at right angles thereto. The projecting portion 227 extends through a slot 229 in a mounting block 268 which has a longitudinal recess in its rear surface to define a guideway 233 in which the anchor plate of the staple slides. The slot 229 has a length more than twice the length of the projecting portion 227 of the staple 226 in the direction of slide movement. The guideway is closed at the rear by a closing plate 269 which sits in rebates at the rear edges of the guideway. After installation of the staple, the closing plate can be secured by turning the rear rebated edges of the guideway to overlap the edges of the slide plate to a small extent.

The mounting block 268 has four countersunk holes 270 to receive bolts which hold the mounting block to the door 201.

Alternatively, the closing plate 269 sitting in rebates can be replaced by a back plate which has the same area as the mounting block and has four holes in corresponding positions to the holes 270, so that it is held between the mounting block and the door 201.

In the closed position, the staple 226 is fully to the left (as seen in FIG. 21) and the apertured projecting portion 227 is received in the slot 7 in the housing. The staple 226 has dimensions slightly smaller than those of the slot 7 and the gap between the arms of the padlock. Bolt 73 is engaged in the aperture 236 in the staple.

To open the locking device, the bolt is released by a key 92 and it springs upwardly out of engagement with staple 226. The rod can then be twisted by the handle 210 as described above to release the general locking mechanism for the door. FIG. 22 shows the locking device of the invention after the rod has been twisted.

The staple 226 can then be pushed fully to the right in slot 229, so that it is clear of the path of the bolt 73, as shown in FIG. 21. When the rod is twisted back again by handle 10, so that the conventional locking mechanism can be reengaged, the locking device according to the invention can be put into the storage position as shown in FIG. 21 but with the bolt closed and the key removed. With the locking device of the invention in the storage position, the conventional locking mechanism can be used along to keep the door closed e.g. when the truck is in use for deliveries. The locking device of the invention can be closed again (as in FIG. 20) when security is required, e.g. when the truck is being parked for a lunch break or overnight.

Figure 24:
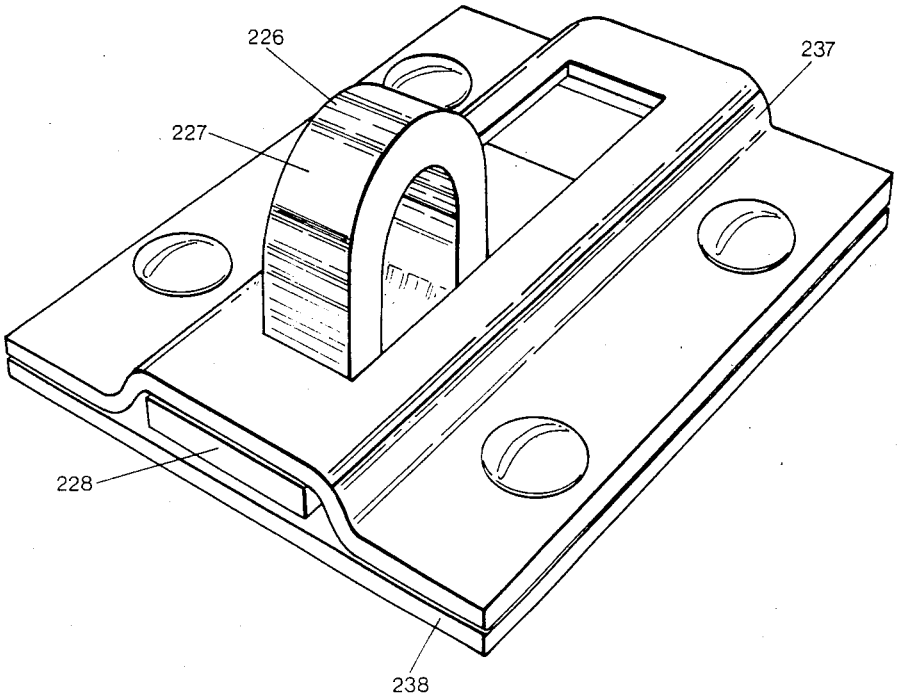
FIG. 24 is a perspective view of an alternative form of staple mounting.
Figure 28:
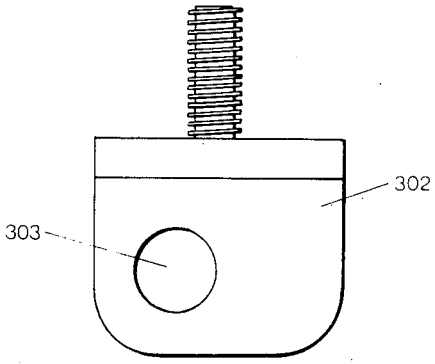
FIG. 28 is a top view of the staple of FIG. 26.
Figure 26:
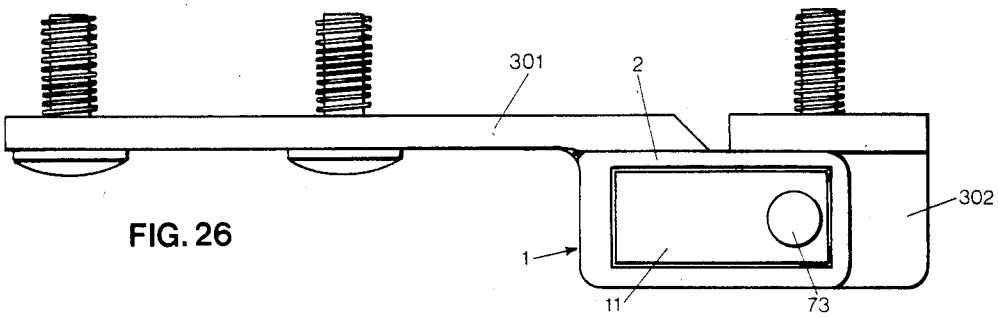
FIG. 26 is a top view of the device of FIG. 25, combined with a staple.
Figure 27:
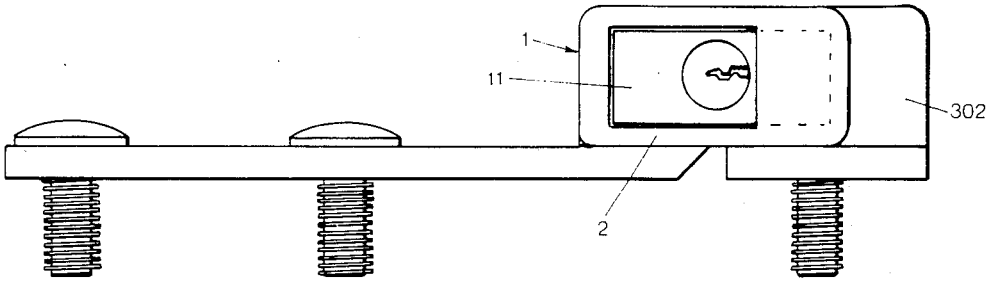
FIG. 27 is an underneath view of the device of FIG. 25, again combined with a staple.
Figure 25:
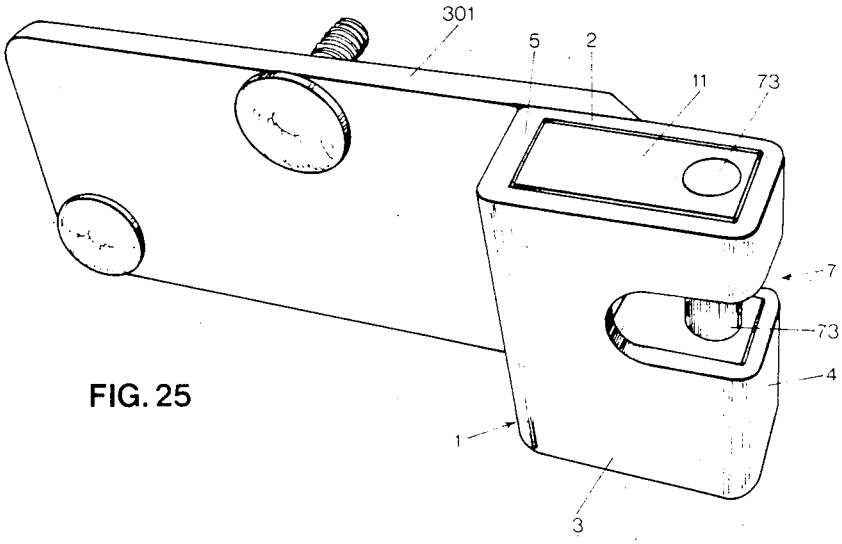
FIG. 25 is a perspective view of an eighth embodiment of a locking device according to the invention omitting the staple.

FIG. 24 shows an alternative mounting arrangment for the staple 226. The mounting block has been replaced by a mounting plate in the form of a saddle bracket 237 and a back plate 238. The anchor plate 228 extends from the staple in both of the directions of sliding movement. The projecting portion 227 of the staple is formed of steel strip bent into a hoop.

Both of the alternative forms for the staple are designed so that they can be used on a right-hand or left-hand door of a truck. FIGS. 20–22 show a locking mechanism for a right-hand door (viewed from the rear of the truck). On a left-hand door, the locking device would be arranged on the opposite side of the locking rod so that the rod can be twisted in the opposite sense.

If desired, the conventional locking device 204–210 can be omitted and a handle for twisting the rod can be attached to padlock housing 216.

The locking device according to the invention is robust and very difficult to damage or tamper with. The padlock is almost inaccessible in the housing and the bolt is protected by the staple as well as the padlock housing. The locking device can be easily installed on an existing twistable rod locking mechanism or can be built-in during the building of a truck body.

The locking device of FIGS. 25–28 comprises a padlock housing 1 of the kind shown in FIG. 1 and a flat hasp plate 301 which is welded to one wall portion 2 in the area thereof which is not cut by slot 7.

The hasp plate can be bolted to a door, such as a sliding van door. If desired, a backing plate can be provided inside the door to strengthen the attachment of the hasp plate to the door. Similarly a staple 302 can be bolted to a frame member or another door. The staple 302 has an aperture 303, through which bolt 73 of padlock 11 is engaged when the device is closed.

The padlock can be retained in the housing by a rivet, or it may be left free so that it can be dropped into the housing and removed therefrom, as required.

Figure 23:
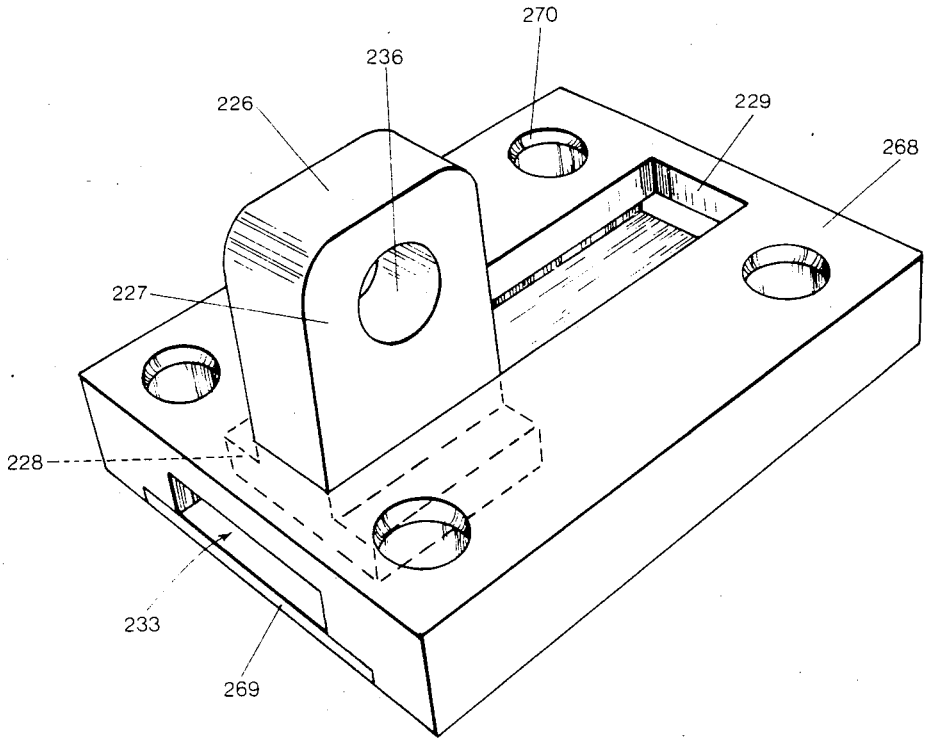
FIG. 23 is a perspective view of a staple mounting in the locking device of FIG. 20.

A staple of the kind shown in FIGS. 23 or 24 can be used, if desired.

The device of FIGS. 25–28 is particularly suitable for van doors of the kind which are displaced to a small extent in a direction perpendicular to the plane of the door, and then slide parallel to the plane of the door. However it can be used in many different situations where there is need for a secure locking device which is resistant to tampering.

Figure 29:
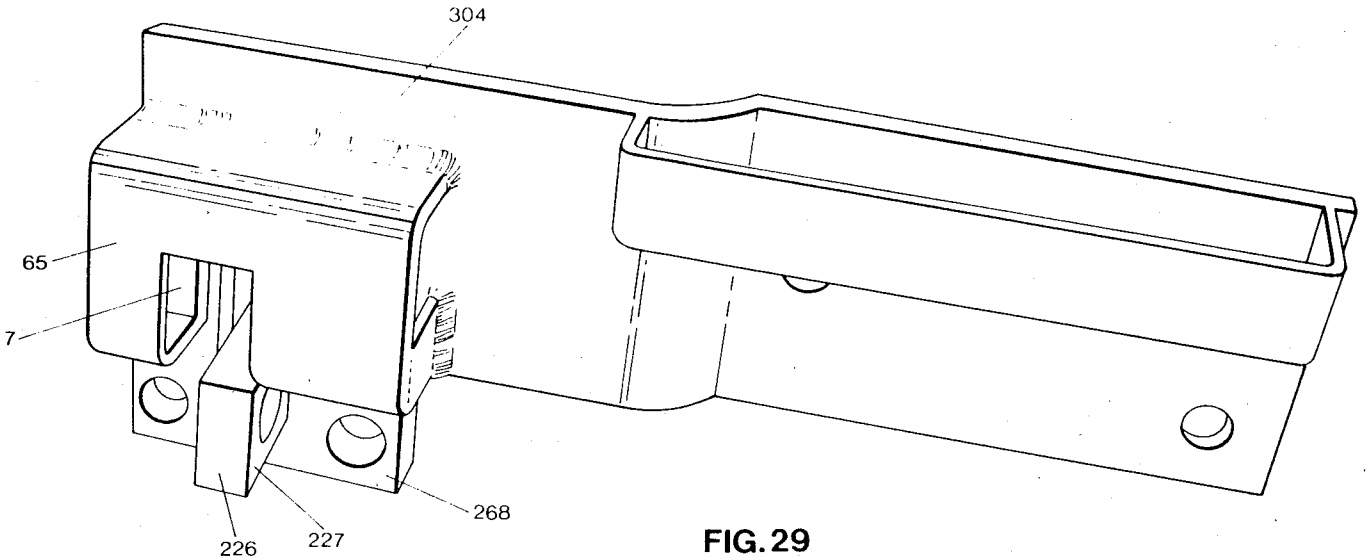
FIG. 29 is a perspective view of a ninth embodiment of a locking device according to the invention.

FIG. 29 shows another embodiment of a locking device similar to that of FIGS. 25–28 except that the housing has been turned through 90° relative to the hasp plate so that the slot 7 opens downwardly in one longitudinal edge of the hasp plate, and the wall portion 2 of the housing is formed by part of the hasp plate 304. The U-shaped shield portion 65 of the housing is welded to the hasp plate as in the embodiment of FIGS. 2–5. The hasp plate can be bolted to a door.

A staple 226 of the kind shown in FIG. 23 is arranged vertically on a frame member or another door, so that the projecting portion 227 of the staple slides vertically downwards out of the line of engagement with the bolt of the padlock (not shown in FIG. 29) when the locking device is not in use. This is the position shown in FIG. 29. When the device is used (for example to lock the doors of a refrigerated delivery vehicle), a padlock is inserted into the housing, the projecting portion 227 of the staple is pushed upwards into the slot 7 and the bolt of the padlock is closed. Alternatively a staple of the kind shown in FIG. 24 can be used.

When the lock is open, the projecting portion of the staple slides downwards under the force of gravity. Therefore even if the padlock is present in the housing with its bolt closed, there is no danger of the bolt hitting the staple when the door is being closed.

In an alternative embodiment, a flat hasp plate having a housing arranged as in FIG. 29 can be pivotally mounted on a horizontal bolt so that the hasp plate can be swung into engagement with a staple. In this case, the staple can be a fixed staple. The hasp plate can conveniently be arranged so that it is swung upwardly to engage the staple, and it drops downwardly into a hanging position when the padlock is open.

If desired, a staple mounting can be provided with a cowl portion which shields the staple and the slotted portions of the housing, when the assembly is locked.

I claim:

1. A locking device comprising a staple and another component to be locked to the staple, wherein a metal padlock housing is formed on or secured to said other component, the housing being dimensioned to receive and shield a sliding-bolt padlock of rectangular configuration having two main flat faces and a side face which has a recess across which the bolt slides, said housing having two wall portions and a foot portion corresponding respectively to said two main faces and said side face of the padlock, the two wall portions being separated by a distance which is marginally greater than the depth of the padlock separating the two main flat faces, so that the padlock is a sliding fit between the said wall portions, said housing also having a slot for entry of the staple into the recess in the padlock to engage the bolt.

2. A locking device according to claim 1, wherein a guard plate is provided at one end of the housing to bridge said wall portions adjacent to said foot portion.

3. A locking device according to claim 1 wherein the housing has a bridge portion between the wall portions at the edges thereof remote from the foot portion.

4. A locking device according to claim 1 wherein the staple has a slide-mounting which permits the staple to slide into and out of the slot in the housing.

5. A locking device according to claim 1 wherein the component to be locked to the staple is a hasp.

6. A locking device according to claim 5 wherein at least part of the hasp forms one of the portions of the housing.

7. A locking device according to claim 1 wherein the component to be locked to the staple is a twistable rod in a twisting-rod locking mechanism.

8. A locking device according to claim 7 wherein the padlock housing is secured to a vertical rod with the two wall portions of the housing arranged vertically, the slot being on the side of the housing remote from the rod.

9. A locking device according to claim 1 wherein the housing is secured to a security post and the staple is formed by an arm hinged to a base tube adjacent to the mouth thereof into which the post fits, a plate fixed to the arm being adapted to be swivelled with the arm between a covering position in which it covers the mouth of the base tube and an upright position in which it stands beside the housing so that part of the arm enters the slot in the housing, an aperture being provided in said part of the arm to engage the bolt of the padlock.

10. A locking device according to claim 1 for locking an assembly of two overlapping elements, wherein the staple is secured to one of the said elements and the padlock housing is secured to a rigid rod or bar which can be passed through the two elements in the overlapping region to prevent relative movement between the two elements.

11. A locking device comprising:

(a) a sliding-bolt padlock of rectangular configuration having two main flat faces and a side face which has a recess across which the bolt slides;

(b) a staple adapted to be secured to a first object; and (c) a metal padlock housing adapted to be secured to a second object which is to be padlocked to the first object, said metal padlock housing having two wall portions and a foot portion, said two wall portions being separated by a distance which is marginally greater than the depth of said sliding-bolt padlock separating the two main faces of said sliding-bolt padlock, whereby said sliding-bolt padlock fits slidingly between said two wall portions, said metal padlock housing having a slot sized, shaped, and positioned so that said staple can pass through said slot and engage said bolt.

* * * * *